United States Patent [19]

Winegard et al.

[11] 4,295,143

[45] Oct. 13, 1981

[54] LOW WIND LOAD MODIFIED FARABOLIC ANTENNA

[75] Inventors: John R. Winegard, Evergreen; Carey W. Shelledy, Lakewood; Keith B. Cowan, Arvada, all of Colo.

[73] Assignee: Winegard Company, Burlington, Iowa

[21] Appl. No.: 121,696

[22] Filed: Feb. 15, 1980

[51] Int. Cl.[3] ..... H01Q 19/12; H01Q 15/20

[52] U.S. Cl. ..... 343/840; 343/915

[58] Field of Search ..... 343/840, 880, 881, 912, 343/915, 916, 914

[56] References Cited

U.S. PATENT DOCUMENTS

| | | | |
|---|---|---|---|
| 1,906,546 | 5/1933 | Darbord | 343/910 |
| 2,049,070 | 7/1936 | Mathieu | 343/840 |
| 2,408,373 | 9/1946 | Chu | 343/915 |
| 2,530,098 | 11/1950 | van Atta | 343/912 |
| 2,613,887 | 10/1952 | Woods | 343/708 |
| 2,703,842 | 3/1955 | Lewis | 343/840 |
| 2,850,735 | 9/1958 | Harris | 343/840 |
| 2,945,234 | 7/1960 | Driscoll | 343/915 |
| 2,990,544 | 6/1961 | La Rosa | 343/100 |
| 3,064,534 | 11/1962 | Tumauicus | 343/915 |
| 3,178,713 | 4/1965 | Yang | 343/840 |
| 3,217,328 | 11/1965 | Miller | 343/840 |
| 3,286,270 | 11/1966 | Kelly | 343/915 |
| 3,329,960 | 7/1967 | Winegard | 343/840 |
| 3,401,390 | 9/1968 | Braccini et al. | 343/915 |
| 3,503,072 | 3/1970 | Thompson | 343/705 |
| 3,509,576 | 4/1970 | McLain | 343/840 |
| 3,518,693 | 6/1970 | Winegard et al. | 343/840 |
| 3,531,805 | 9/1970 | Winegard et al. | 343/840 |
| 3,599,218 | 8/1971 | Williamson et al. | 343/840 |
| 3,618,101 | 11/1971 | Emde et al. | 343/705 |
| 3,964,071 | 6/1976 | Townes et al. | 343/840 |
| 4,001,836 | 1/1977 | Archer et al. | 343/756 |

FOREIGN PATENT DOCUMENTS

| | | | |
|---|---|---|---|
| 1390628 | 4/1975 | United Kingdom | 343/915 |

*Primary Examiner*—Eli Lieberman

*Attorney, Agent, or Firm*—Robert C. Dorr

[57] ABSTRACT

A modified parabolic antenna exhibiting low wind load characteristics having a collapsible reflector boom and a plurality of reflector elements mounted thereon. The collapsible boom includes two symmetrical parabolically shaped half sections. A first and second series of thin substantially elongated rectangular shaped reflector elements are mounted to each boom in a predetermined spaced relationship. Each reflector element is identical to the other and is also parabolically curved.

24 Claims, 24 Drawing Figures

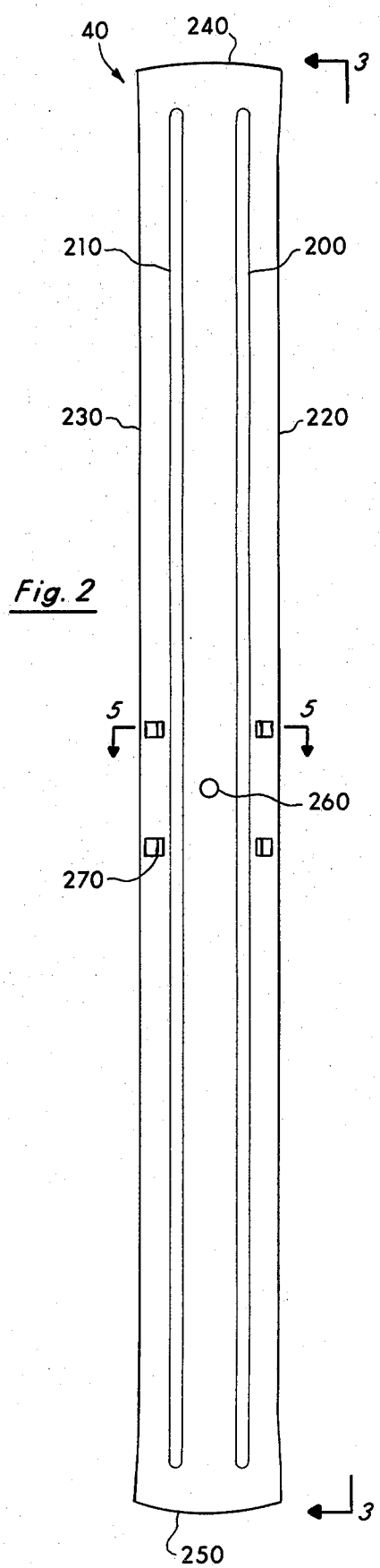
Fig. 2
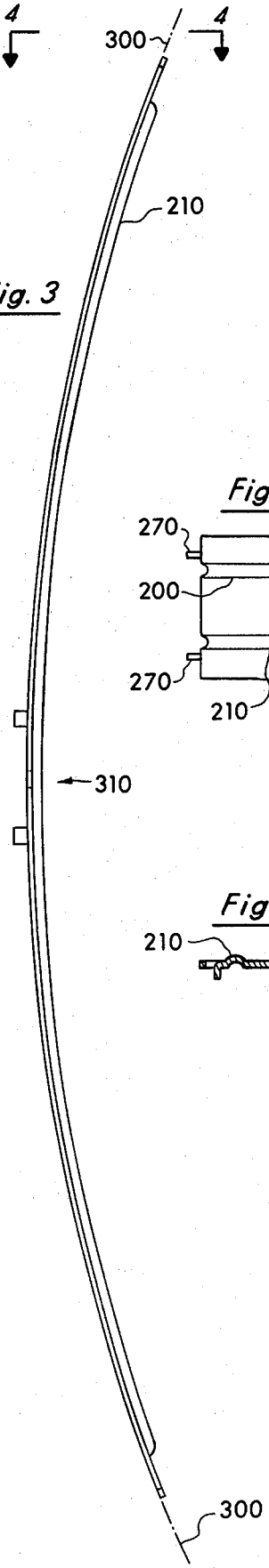
Fig. 3
Fig. 4
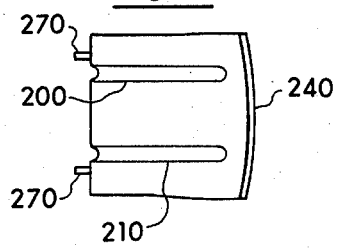
Fig. 5
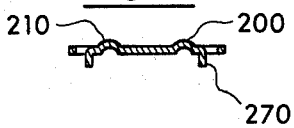

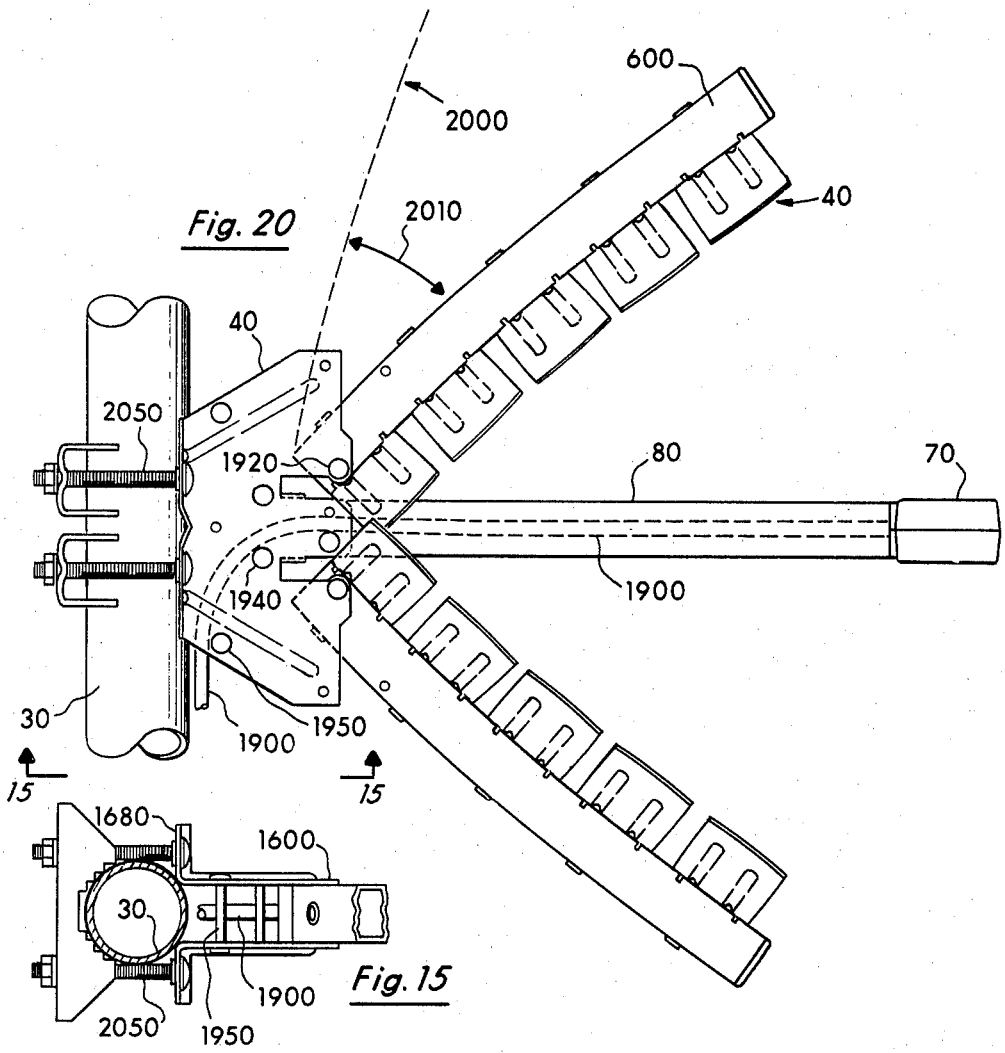
Fig. 20
Fig. 15
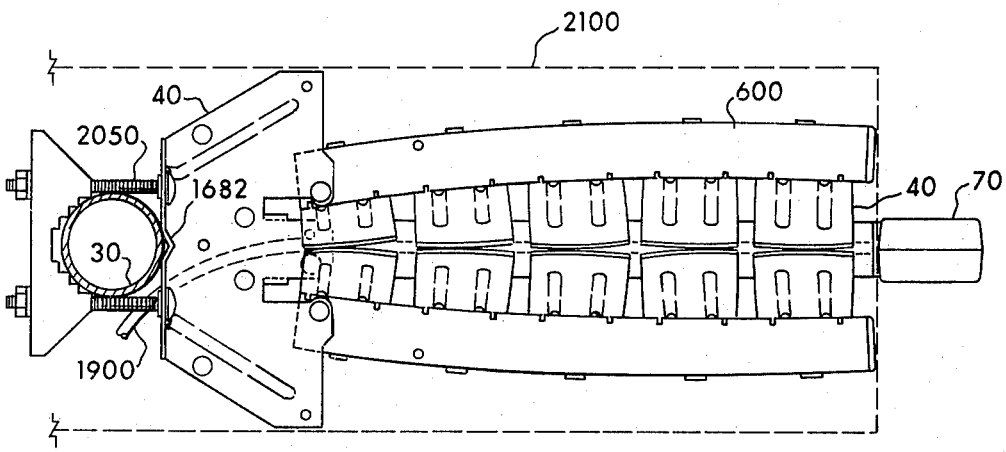
Fig. 21

LOW WIND LOAD MODIFIED FARABOLIC ANTENNA

BACKGROUND OF THE INVENTION

1. Field of the Invention

This invention relates to parabolic antennas and more particularly to parabolic antennas which have low wind load characteristics and parabolic antennas which are collapsible.

2. Prior art

Dish-shaped parabolic antennas are well known. Such antennas come in a variety of shapes and sizes all of which are readily identifiable by a solid dish configuration having a three-dimensional parabolic surface with a sensor mounted at the focal region of the parabolic surface.

These dish-shaped antennas have a common problem in the characteristic high wind load that is exhibited. Not only must the antenna dish itself be structurally designed to withstand high wind forces but the corresponding support structure must also be so designed. All in all, common dish-type parabolic antennas and their support structure are heavy and sturdy enough to withstand substantial environmental forces. Additionally, dish-type parabolic antennas are difficult to transport because they occupy a significant volume of space.

Some prior art approaches have attempted to minimize the wind load characteristics of parabolic dish antennas. In one approach, a wire mesh, resembling a screen, is disposed on a three dimensional parabolic surface with a support framework disposed around the periphery. In U.S. Pat. No. 3,329,960 commonly assigned with the present invention, a collapsible parabolic antenna having minimal wind load was set forth.

With the advent of home box office services and other types of communication networks, a need exists for a consumer parabolic antenna having an acceptable low price in the market place. Such an antenna should be retrofitable to the existing television antenna market place utilizing light weight support poles or masts.

The present invention recognizing the problems existing with prior parabolic antennas and recognizing the challenge facing the demand for a consumer parabolic antenna offers a solution. The present invention is a modified parabolic antenna which is fully collapsible for ease in transportation, which exhibits low wind load characteristics and which is capable of being mounted to conventional television masts as supports. Furthermore, in order to keep costs at a minimum, the present antenna minimizes the overall number of part components for ease in inventory and for low cost manufacturing. As will be pointed out subsequently, the antenna of the present invention utilizes a plurality of identically shaped reflector elements which are spaced from each other onto identical and symmetrical supports.

OBJECTS OF THE INVENTION

It is an object of the present invention to provide a new and novel parabolic antenna exhibiting low wind characteristics.

It is an object of the present invention to provide a new and novel parabolic antenna which is fully collapsible for shipping.

It is another object of the present invention to provide a new and novel parabolic antenna which uses a plurality of identically shaped reflector elements which are mounted in predetermined spaced distances on a parabolic support boom.

SUMMARY OF THE INVENTION

The antenna of the present invention includes a parabolically shaped boom, a plurality of reflector elements mounted on the boom and a mount affixed to the boom for supporting the boom and reflector elements to a support. A conventional driven element or sensor is supported from the mount in the focal region of the parabolic antenna of the present invention.

The boom includes two symmetric half sections which are made from square tubing and which form a parabolic configuration. Each half section is pivotally connected to the mount near the vertex region so that the half sections can pivot between a full outward position wherein the boom sections form the parabolic curve to a fully collapsed inward position wherein the two half sections longitudinally oppose each other.

The reflector elements, each identical in shape to the other, are formed from thin long rectangular material curved in the substantial shape of a parabola. Each reflector element is centrally affixed in its midsection or vertex to the boom and are spaced apart from each other so that the widths between the reflector elements, in the plane perpendicular to the incoming signal, is constant.

The mount is capable of connecting to the support to hold the antenna either in a vertical or horizontal orientation.

DESCRIPTION OF THE DRAWING

FIG. 2 is the front planar view of a reflector element of the present invention;

FIG. 3 is a side planar view of the reflector element of FIG. 2;

FIG. 4 is an end planar view of the reflector element of FIG. 2;

FIG. 5 is a cross-section through the midcenter of the reflector element of FIG. 2;

FIG. 15 is a top planar view of the antenna of the present invention mounted horizontally detailing the area of the connection to the support post;

FIG. 20 is a top planar view of the assembled antenna of the present invention in a pivoting orientation;

FIG. 21 is a top planar view of the assembled antenna of the present invention fully collapsed;

GENERAL DESCRIPTION

Figure 1:
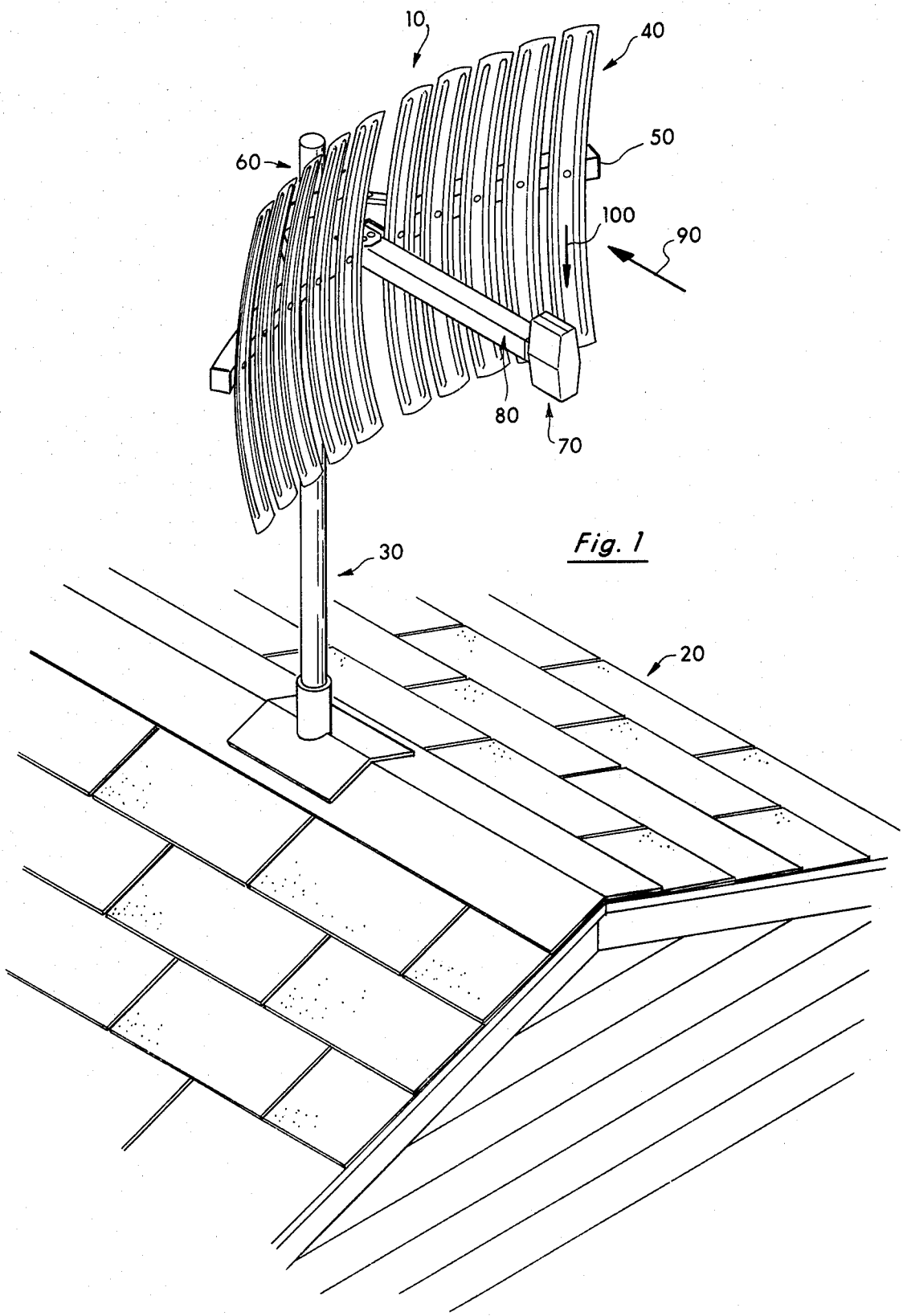
FIG. 1 sets forth a perspective view of the antenna of the present invention mounted so that the antenna is oriented to receive a vertical polarized signal.

In FIG. 1, the modified antenna 10 of the present invention is shown mounted to the roof 20 of a building by means of a support 30. The antenna 10 is a modified parabolic antenna having a series of reflector elements 40 mounted to a parabolic boom 50 which in turn is connected to the support 30 by means of a mount 60. A driven element or sensor 70 is mounted in the focal area of the parabolic antenna 10 and is supported in that position by means of a driven element support boom 80.

In operation, incoming wave front 90 from the signal are reflected by the elements 40 into the driven element 70. The reflected wave front of the signal is generally designated 100.

The antenna 10 is designed to operate in two orientations. The orientation shown in FIG. 1 is the vertical orientation (i.e., the driven element 70 is aligned vertically). The antenna 10 can also be oriented so that the driven element 70 is horizontal.

It can be observed by inspection of FIG. 1 that the wind load of antenna 10 is significantly less than the wind load of a conventional dish-parabolic antenna. Wind easily flows between the reflector elements 40. The reduced wind load characteristics and the light weight of the antenna 10 of the present invention result in a significantly less substantial support 30 than in conventionally used on parabolic antennas. Specifically, the antenna 10 of the present invention can be mounted onto a standard television support mast.

DETAILED DESCRIPTION

1. Reflector Elements

Each of the reflector elements 40 in the preferred embodiment, are identical in shape as shown in FIGS. 2 through 5. These reflector elements are shown in FIGS. 2 and 3 to be of an elongated rectangular configuration formed from aluminum or the like. The element 40 is formed around an arced piece so that it follows a substantially parabolic shape along its longitudinal axis 300 as shown in FIG. 3. In the region of the vertex of a parabola it is substantially a circular arc and, hence, the arc near vertex 310 of element 40 is substantially circular. In manufacturing the preferred embodiment, these elements are rolled on a circular piece.

In order to provide structural strength for the environmental forces, two embossments or ridges 200 and 210 are formed along opposing edges 220 and 230, respectively. These embossed ridges, 200 and 210, do not extend to edges 240 and 250 and, hence, when the embossing occurs the ends flange slightly outward from edges 220 and 230.

An attachment hole 260 is located in the center, longitudinally and laterally, (i.e., the vertex of the element parabola) of each element 40. Four locking tabs 270 are stamped about the hole 260. These locking tabs 270 extend out perpendicular to the surface of the element 40 as shown in FIG. 4. FIG. 5 sets forth, in cross section, the orientation of the locking tabs 270.

In FIGS. 2 through 5, a preferred embodiment of the shape of each reflector element, of the embossment to add structural strength, and a single point of affixation of the element to a boom is set forth. It is to be understood, however, that the present invention should not be limited to such a preferred approach. The element shapes need not be identical to each other, need not be of an elongated rectangular shape, need not be embossed as shown, and need not be affixed in the preferred manner to practice the teachings of this invention as pointed out in the claims.

2. The Reflector Element Boom

Figure 6:
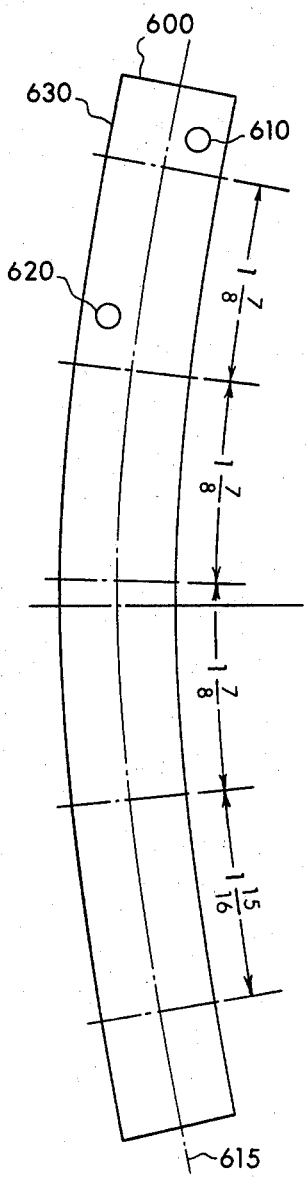
FIG. 6 is a side planar view of a boom half section for a ten reflector element antenna of the present invention.
Figure 7:
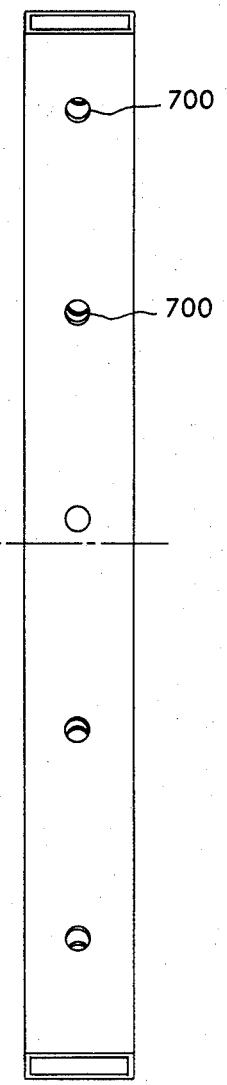
FIG. 7 is a front planar view of the boom half section of FIG. 6.

Two preferred embodiments of the element boom 50 of the present invention is shown in FIGS. 6 through 10. The first embodiment shown in FIGS. 6 and 7 is designed for holding five elements 40. What is shown in FIGS. 6 and 7 is one-half of the overall boom and, hence, FIGS. 6 and 7 illustrate a boom half section for a ten reflector element antenna of the present invention. The boom half section 600 is made from square tubing material and is light weight. A rolling fixture bends the tubing material into the parabolic shape along its longitudinal axis 615. This forms one leg of the overall parabola as best shown by reference back to FIG. 1. A plurality of holes 700 are drilled into the half section 600 at predetermined spaced locations. Typical values, in inches, for these orientations are shown in FIG. 6. These holes 700 are drilled perpendicular to the surface as best seen in FIG. 6. As subsequently will be explained, holes 700 comprise attachment points for each of the reflector elements 40. Additionally, two holes 610 and 620 are drilled near end 630 of the half section 600. These holes 610 and 620 will be utilized to mount the boom half sections, as will be subsequently explained, to mount 60 which in turn is connected to the support 30.

Figure 8:
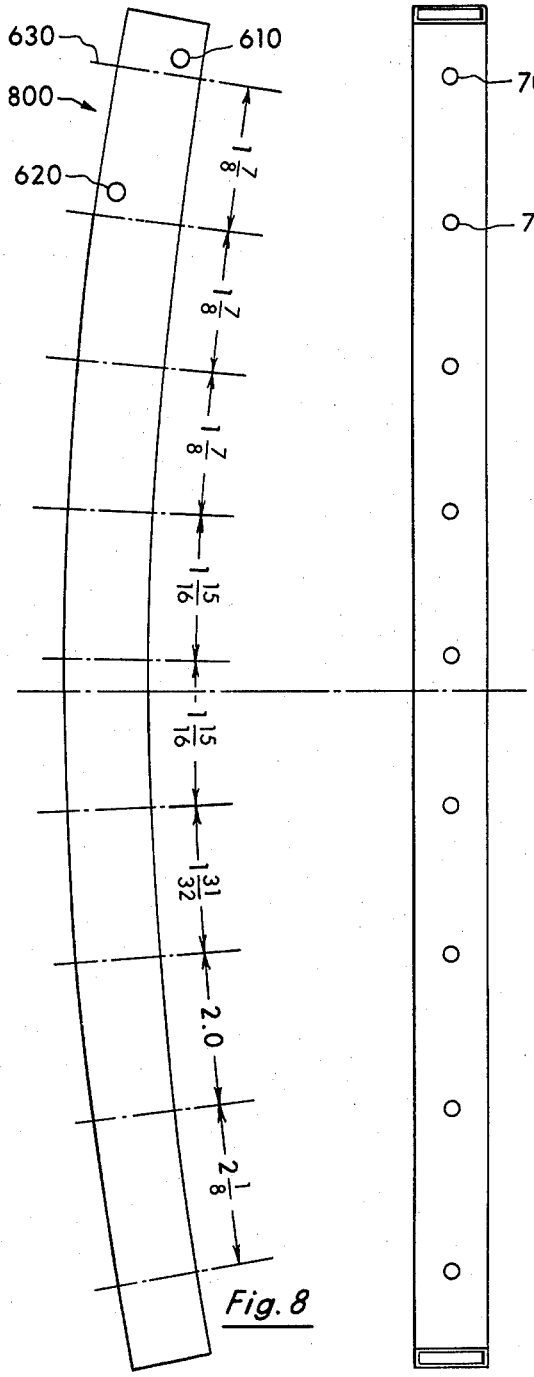
FIG. 8 is a side planar view of a boom half section for an eighteen reflector element antenna of the present invention.
Figure 9:
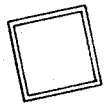
FIG. 9 is an end view of the boom support of FIG. 8.
Figure 10:
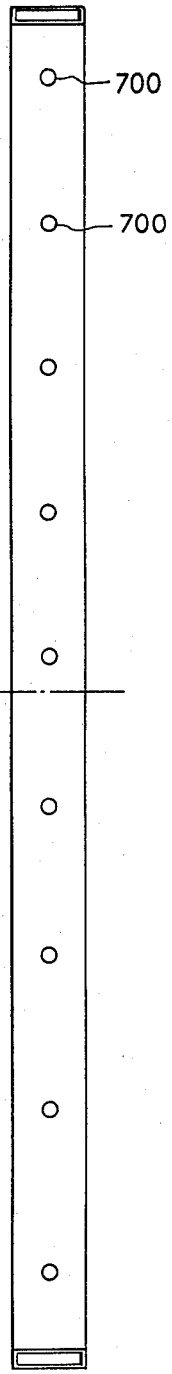
FIG. 10 is a front planar view of the boom half section of FIG. 8.

In FIGS. 8 through 10, are shown the boom half section 800 for an 18 reflector element antenna 10 of the present invention. Wherever possible, the same designation numbers will be utilized, as for the ten element antenna shown in FIGS. 6 and 7 for the sake of consistency and clarity. Again, typical values, in inches, are given for the spacings between the holes 700.

Figure 12:
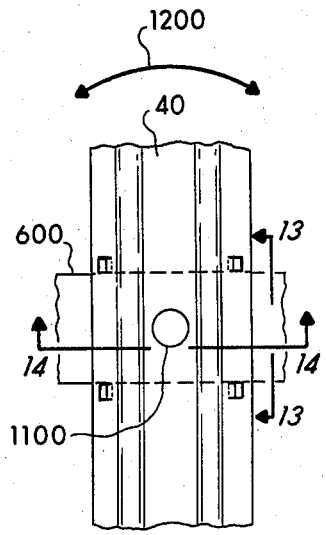
FIG. 12 is a partial top planar view of the mounting of a reflector element to a boom half section.
Figure 13:
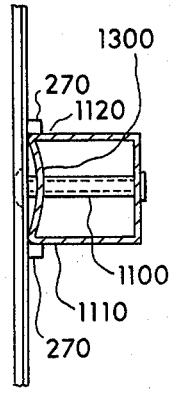
FIG. 13 is a side cross-section of FIG. 12 detailing the interior of the boom half section.
Figure 14:
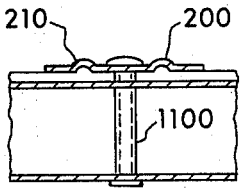
FIG. 14 is a side cross-sectional view of FIG. 12 showing the connection of the reflector element to the boom half section.
Figure 11:
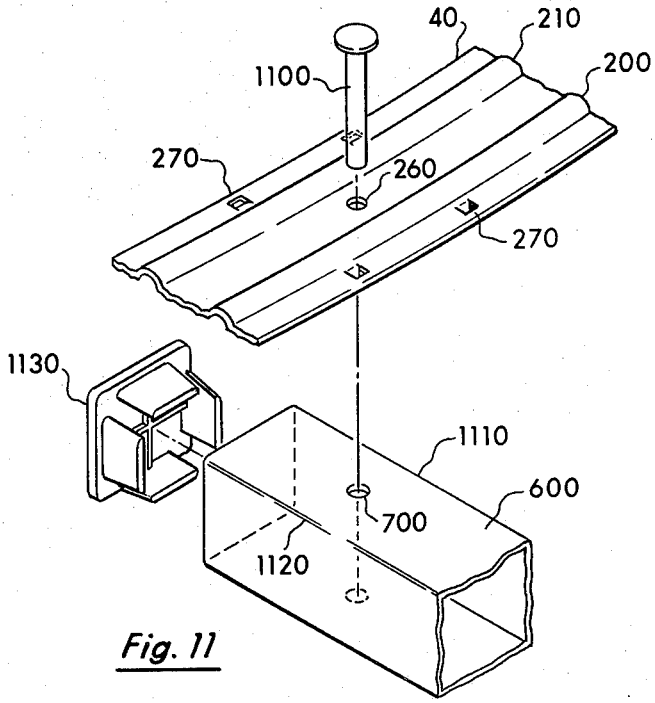
FIG. 11 is a partial perspective exploded view of the connection of a reflector element to a boom half section.

In FIG. 11 is shown the mounting of a reflector element 40 to a half section 600. A rivet 1100 engages hole 260 of element 40 and hole 700 of half section 700 and is firmly riveted into position so that the element 40 is firmly attached to half section 600. Locking tabs 270 are used to align the element 40 along the edges 1110 and 1120 of the half section 600. This is better shown in FIGS. 12 through 14. The locking tabs 270 firmly abut against the edges 1110 and 1120 to prevent the element 40 from twisting or turning in the direction of arrow 1200. The locking tabs 270 are located substantially perpendicular to surfaces 1110 and 1120 to provide the greatest strength against flexing or release of the tabs. As can be shown in FIG. 13, the surface 1300 of the half section 600 nearest the element is bowed inwardly. The bow is created in the manufacturing of boom half section and is caused by the bending of the square tubing in the parabolic curve.

A formed boom end plug 1130 is inserted in the end of each boom half section to prevent snow, ice or dirt accumulation and to prevent a whistling noise.

It is to be expressly understood that the above discussion relates to the preferred embodiment and that variations and modifications could be made within the scope of the present invention. For example, the two separate boom half sections could be formed from a single piece of tubing in which case the antenna 10 of the present invention would not be collapsible. Also, different materials and configurations for the boom, other than square tubing, could be utilized.

3. The Mounting Brackets

Figure 16:
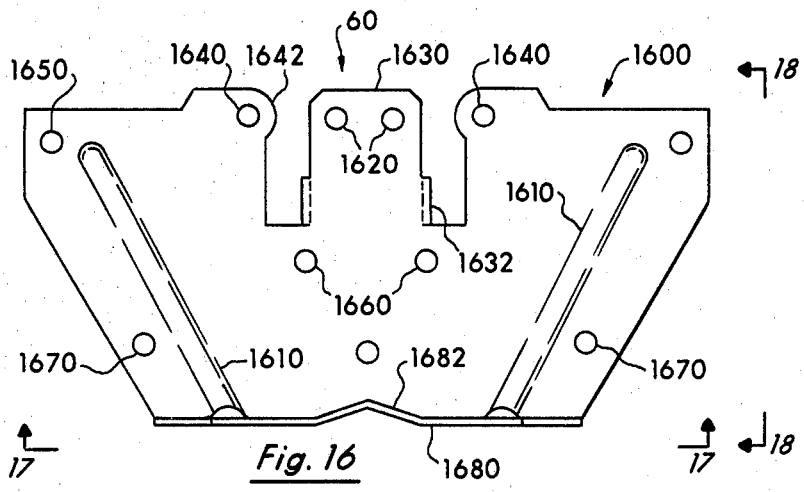
FIG. 16 is a side planar view of the mounting bracket of the present invention.
Figure 18:
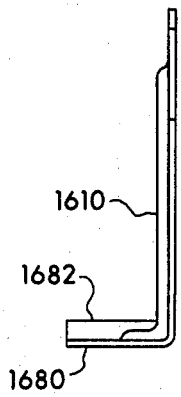
FIG. 18 is a side planar view of the mounting bracket of FIG. 16.
Figure 17:
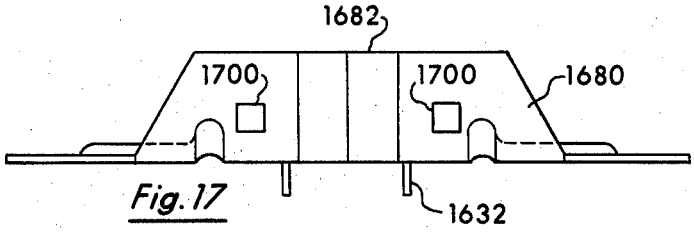
FIG. 17 is a bottom planar view of the mounting bracket of FIG. 16.

The symmetrical halves 1600 of the mounting bracket 60 are shown in FIGS. 16 through 18. The mounting half 1600 contains a number of holes and is composed of relatively thin metal as shown by reference to FIGS. 17 and 18. Angular embossments 1610 are provided for structural strength to each mounting half.

Figure 19:
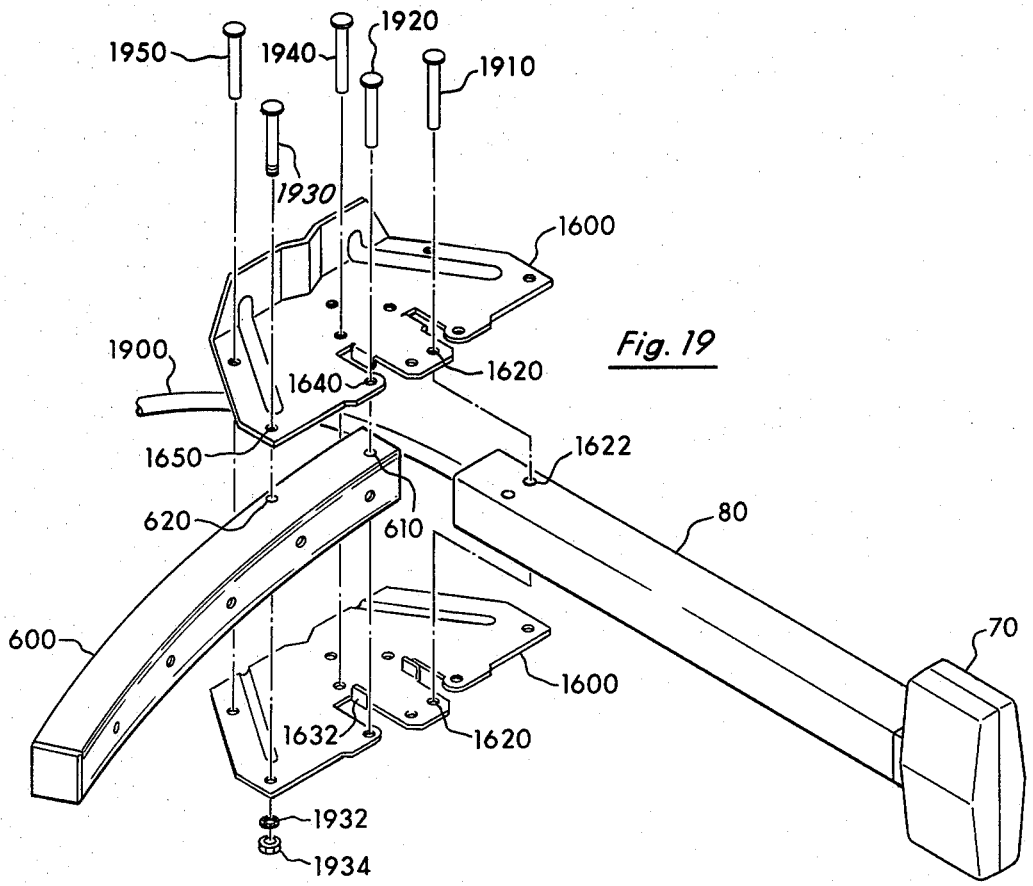
FIG. 19 is an exploded perspective view detailing the assembly of the mounting brackets to the boom half sections and to the driven element.

In FIG. 19 the assembly of the boom half section 600 and the driven element support 80 carrying the coaxial cable 1900 to the driven element 70 to the two symmetrical mounting brackets 1600 is set forth. A rivet 1910 is assembled through a hole 1620 and through corresponding hole 1622 to firmly engage the driven element boom 80 to the mounting halves 1600. Two holes are provided to make the mounting half 1600 symmetric with each other and only one rivet 1910 is utilized. The holes 1620 are oriented on an outwardly extending protrusion 1630 of the mounting plate 1600. On protrusion 1630 are formed two inwardly extending tabs 1632 as best shown in FIG. 17. These inwardly directed tabs 1632 abut either side of driven element boom 80 and hold it firmly in position.

At this stage, the support boom 80 carrying the driven element 70 and the coaxial cable 1900 is firmly riveted by means of one rivet 1910 to the two mounting halves 1600 and is aligned therewith by means of tabs 1632.

The boom half section 600 is mounted between the two mounting plates 1600 by means of a rivet 1920 which passes through hole 1640, through hole 610 and is firmly riveted into place. As will be explained subsequently, the boom half section 600 is able to pivot about rivet 1620. The hole 1640 is oriented on an outwardly extending arcuate region 1620 which is spaced from the extending region 1630 by the mount to allow the boom to pivot. A bolt 1930 is then inserted through the hole 1650 and through hole 620 of the boom 600 and is attached by means of a star washer 1932 and a nut 1934. The bolt 1930 is selectively inserted when the boom is fully extended outwardly and is aligned to receive the bolt 1930. The combination of the bolt 1930 and the rivet 1920 affixedly hold the boom half section 600 between the two mounting plates 1600 at a predetermined orientation to form a parabola shape.

Two holes 1660 are drilled in the mounting plate 1600 just below the extension 1630 and on opposing sides therewith. These holes are in substantial agreement with the tab 1632. Holes 1660 receive corresponding rivets 1940 which serve an important function when riveted into position. These two rivets prevent the cable 1900 from abutting against the sharp ends of the square tubing 1600. If the cable 1900 were allowed to abut the ends, a cutting action would occur through and into the cable due to the moment forces caused by the environment. This will be explained in more detail subsequently.

The mounting plate 1600 is shaped in the form of an L having an outwardly extending lip 1680 as best shown in FIG. 18. This lip 1680 has a formed V-shaped groove 1682 which is used to receive a support mast in order to mount the antenna 10 of the present invention in the vertical position.

Two holes 1670 are located near this lip 1680 and are designed to receive rivets 1950. These rivets 1950 also serve the function of guiding the cable in an arcuate fashion when the antenna is mounted horizontally as will be described subsequently. Rivets 1940 and 1950 also provide structural strength to hold the bracket together to prevent spreading of the bracket when mounted. Hence, when the mounting brackets are fully assembled, with the boom elements outwardly extending, eight connection points exist. These connection points are also oriented to minimize the various moment forces on the antenna. For example, holes 1640 and 1650 are off center from the longitudinal axis of the support boom 600 in order to provide a positive connection thereto to carry any boom forces. Furthermore, rivet 1910 connecting the mounting plate to the driven element boom is also off center to allow the coax cable 1900 to pass through but also to take out the moment force of the driven element boom 80 as it appears on the tabs 1682. This essentially makes the mounting bracket 40 capable of carrying the wind load of the driven element boom 80.

The above presented mounting bracket configuration represents the preferred embodiment. However, different configurations could also be utilized to carry out the teachings of the present invention.

4. Collapsible Capabilities

Figure 22:
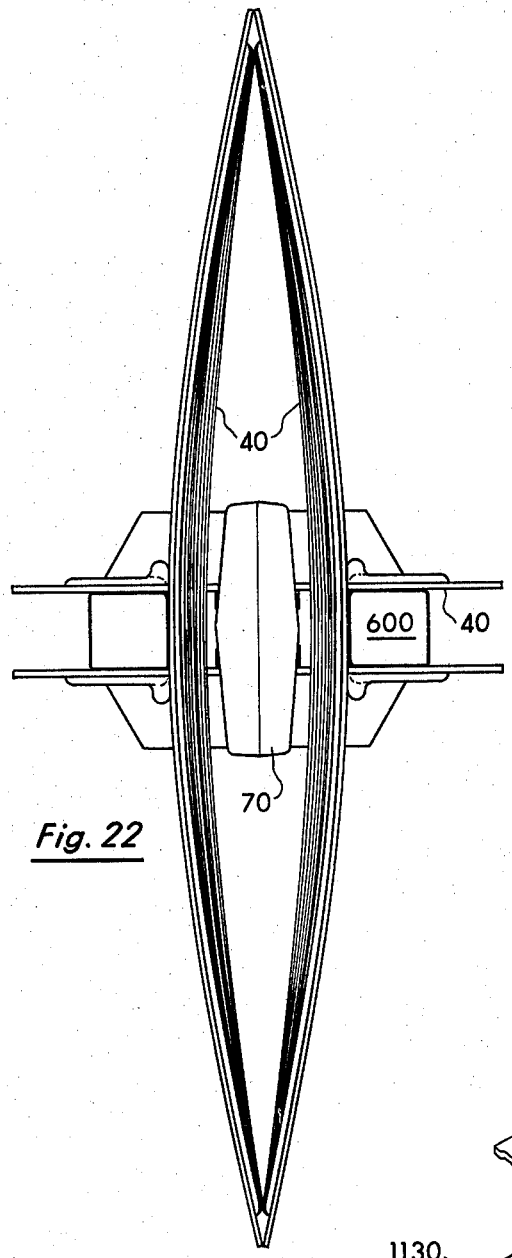
FIG. 22 is an end planar view of the antenna of the present invention fully collapsed.

FIGS. 20 through 22 set forth the collapsible nature antenna of the present invention. In FIG. 20, the boom half sections 600 are capable of pivoting about rivets 1920 when the bolts 1930 are removed. When the bolt is inserted, the boom 600 is fully extended and occupies the orientation indicated by dotted lines 2000. The boom half section 600 can pivot in the direction of arrows 2010. When fully collapsed, the antenna 10 of the present invention occupies the orientation shown in FIGS. 21 and 22.

It is to be noted that when fully collapsed, the antenna has a highly compact configuration which is easy to box and ship. It is to be noted that a shipping box 2100 can be rectangular in shape and is highly compact.

As previously mentioned and as shown in FIG. 20, the cable 1900 bends around rivet 1940 and is prevented from abutting the ends of the half section 600 to eliminate any cutting. The cable also is near rivet 1950 which forms a gentle arc for the cable 1900 to follow.

Figure 23:
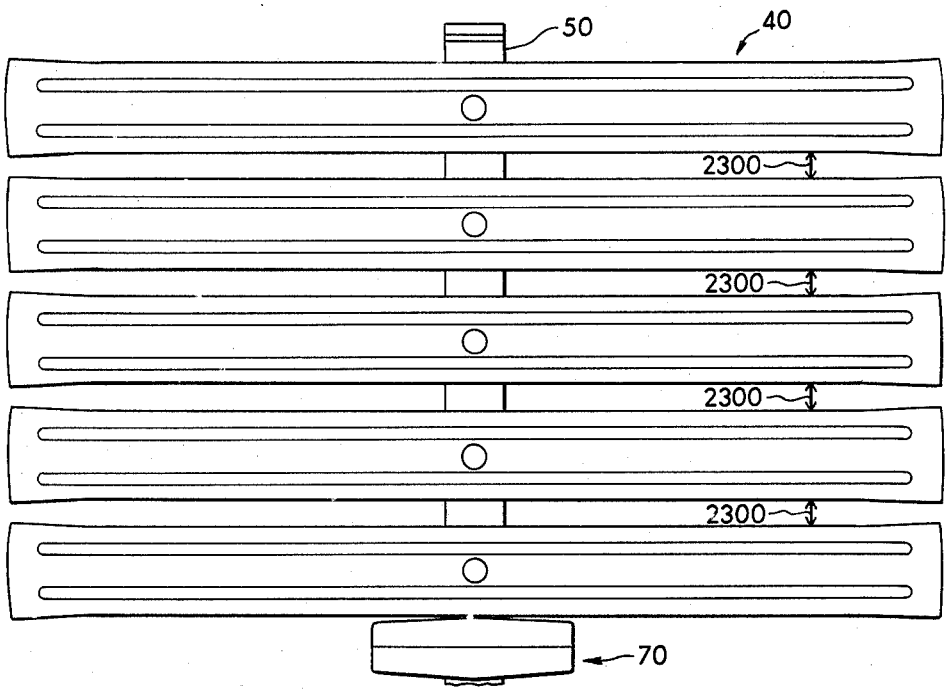
FIG. 23 is an illustration setting forth the equal spacing between the reflector elements in the plane perpendicular to the incoming signal.

The antenna can be mounted horizontally as shown in FIG. 20 with the driven element horizontal. The support mast 30 is affixed by means of clamps 2050 (such as Winegard part No. M-60) and carriage bolts 2052 to the mounting bracket 60. The clamps 2050 are mounted with bolts 2052 to holes 1700 as best shown in FIG. 17. In FIG. 23, the details of this horizontal connection is shown.

The vertical mounting of the antenna is shown in FIG. 21. The vertical mounting of the support 30 abuts in the channel formed by the V-shaped configuration 1682.

Figure 24:
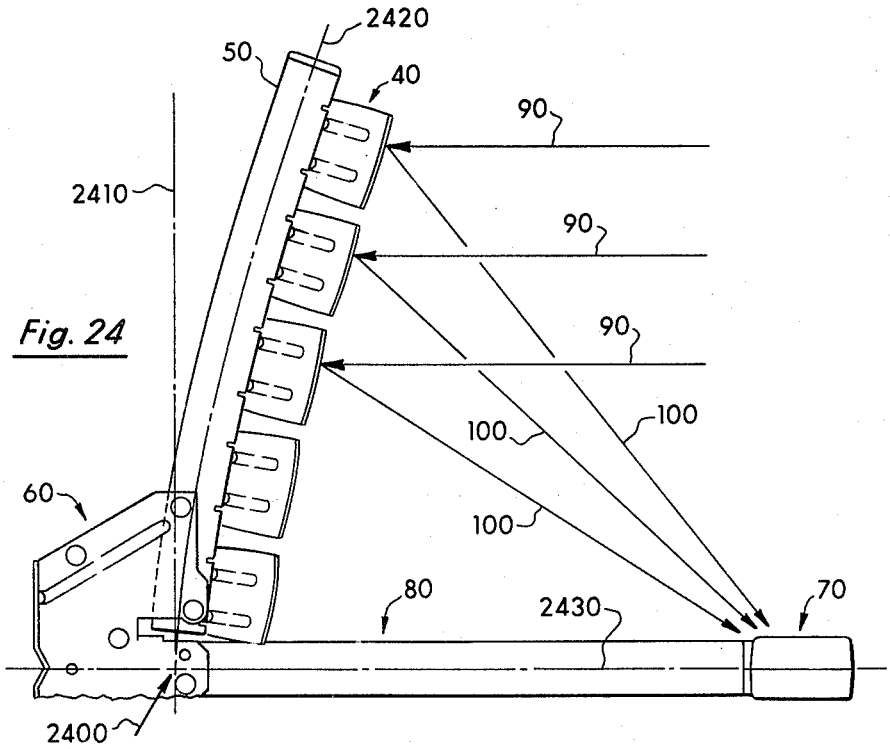
FIG. 24 is an illustration setting forth the reflection of the captured signal into the driven element.

FIGS. 23 and 24 set forth one-half of the antenna of the present invention with the half section 50 mounted in the open orientation to the mount 60. In this orientation, in a plane perpendicular to the path of the incoming wave front of the signal, the spacings 2300 between the reflector elements 40 are equal. Hence, to the incoming wave front of the signal 90, the antenna 4 of the present invention appears substantially electrically solid although physically it is not.

The spacing 2300 was experimentally arrived at. With no spacing, it is clear the antenna would exhibit a maximum electrical response, but it would also exhibit a maximum wind load. By increasing the spacing, response decreases but so does the overall wind load. The spacing arrived, approximately ½ inch represents an optimum trade off relationship between the two factors of response and wind load.

The 18 element antenna of the present invention is approximately 40 inches long and 15 inches wide, the length of each element 40 being 15" from tip-to-tip in a straight line and 1½" wide.

In electrical performance and gain, the 18 element antenna of the present invention is comparable in electrical performance and gain to a 2' diameter dish antenna. However, the wind load is substantially less, weight is substantially less (e.g., 3–4 lbs. v. 10–15 lbs.), the support structure is significantly lighter weight (e.g., ¾–1½" dia. v. 3"–4" dia. of support mast), the shipping is easier, and the retail costs are significantly less (e.g., $40–$50 v. $180–$200). The addition of more elements 40 increases the gain by increasing the capture area. More reflection occurs further out from the center of the antenna.

While the embodiment set forth above represents the preferred configuration, it is to be expressly understood, that changes in the configuration especially as to the sizes and shapes in the various components can be made without departing from the spirit of this invention.

We claim:

1. An improved modified and collapsible parabolic antenna for receiving incoming signals having low wind load characteristics mounted to a support, said antenna having means for sensing reflected signals in its focal area, said improved antenna comprising:

an elongated boom having two symmetrical half sections, said boom being further formed to follow a substantially parabolic orientation along its longitudinal axis, a first and second series of reflector elements for reflecting said incoming signals to said sensing means, each of said series being mounted to one of said half sections of said boom, each of said first and second series of reflector elements comprising:

(a) a plurality of thin substantially elongated rectangular elements of equal length being formed in the substantial shape of a parabola along its longitudinal axis, and (b) means for mounting the mid-section of each of said elements in a substantial perpendicular relationship to said boom at equal predetermined spaced distances from each other, said predetermined spaced distance being determined in a plane perpendicular to the path of said incoming signals, and means releasably connectable to said support for mounting to one end of each of said boom half sections in the region of the vertex of said boom parabolic shape, said boom half sections being capable of pivoting in said mounting means from an outward position wherein said boom half sections form said parabolic shape to an inward position wherein said boom half sections are in substantial opposing parallel relationship.

2. The modified and collapsible antenna of claim 1, wherein each of said reflector elements have at least one embossment substantially extending the entire longitudinal length of said element for providing structural strength to said element.

3. The modified and collapsible antenna of claim 1 wherein said mounting means for each of said reflector elements comprises:

a single fastener connecting the center of said element to said boom, and means on said element for engaging the exterior of said boom to prevent said reflector element from pivoting about said fastener and for orienting said reflector element in said perpendicular relationship to said boom.

4. The modified and collapsible parabolic antenna of claim 1 wherein said mounting means is capable of mounting said boom to said support in a vertical or in a horizontal orientation.

5. An improved modified parabolic antenna for receiving incoming signals having low wind load characteristics mounted to a support, said antenna having means for sensing reflected signals in its focal area, said improved antenna comprising:

an elongated boom having two symmetrical ends, said boom being further formed to follow a substantially parabolic orientation along its longitudinal axis, a first and second series of reflector elements for reflecting said incoming signals to said sensing means, each of said series being mounted to one of said symmetrical ends of said boom, each of said first and second series of reflector element comprising:

(a) a plurality of thin substantially elongated rectangular elements of equal length being formed in the substantial shape of a parabola along its longitudinal axis, and (b) means for mounting the mid-section of each of said elements in a substantial perpendicular relationship to said boom, and means releasably connectable to said support for mounting said boom in the region of the vertex of said boom parabolic shape.

6. The modified antenna of claim 5, wherein each of said reflector elements have at least one embossment substantially extending the entire longitudinal length of said element for providing structural strength to said element.

7. The modified parabolic antenna of claim 5 wherein said mounting means is capable of mounting said boom to said support in a vertical or in a horizontal orientation.

8. The modified antenna of claim 5 wherein each of said reflector elements are spaced from each other in equal predetermined distances, said predetermined distances being determined in a plane perpendicular to the path of said incoming signals.

9. A modified parabolic antenna for receiving incoming signals having low wind load characteristics mounted to a support, said antenna having means for sensing reflected signals in its focal area, said antenna comprising:

an elongated boom connected to said support and having two symmetrical ends, said boom being further formed to follow a substantially parabolic orientation along its longitudinal axis, a first series of spaced reflector elements mounted on one of said ends, and a second series of spaced reflector elements mounted on the other end, all of said reflector elements in said first and second series being substantially parabolic in shape, being of equal length and being capable of reflecting said incoming signals into said sensing means.

10. An improved collapsible parabolic antenna for receiving incoming signals mounted to a support, said antenna having means for sensing reflected signals in its focal area, said improved antenna comprising:

an elongated boom having two symmetrical half sections, said boom being formed to follow a substantially parabolic orientation along its longitudinal axis, a first series of reflector elements being substantially parabolic in shape affixed to one of said half sections, a second series of reflector elements being substantially parabolic in shape affixed to the remaining one of said half sections, said first and second series of reflector elements being capable of reflecting said incoming signals to said sensing means, all of said reflector elements in said first and second series being identical in shape, means releasably connected to said support for mounting to the inwardly directed ends of each of said half sections, said boom half sections being capable of pivoting in said mounting means from an outward position wherein said boom half sections form said parabolic shape to an inward position wherein said boom half sections are in substantial parallel relationship, and means selectively engaging said mounting means and said boom half sections for holding said boom half sections in said outward position.

11. The collapsible parabolic antenna of claim 10 wherein said reflector elements are spaced from each other at a predetermined distance, said predetermined distance determined in a plane perpendicular to the wave front of said incoming signals.

12. An improved modified parabolic antenna mounted to a support for receiving incoming signals, said antenna having means for sensing reflected signals in its focal area, said improved antenna comprising:

a plurality of identical parabolically shaped reflector elements receptive of said incoming signals for reflecting the aforesaid signals to said sensing means, and means releasably connected to said support for holding, in spaced relationship from each other, said reflector elements at the mid-region of each of said reflector elements, in a substantial parabolic orientation.

13. The modified antenna of claim 12 wherein said spaced relationship is determined in a plane perpendicular to the plane of the wave front of said signals.

14. The modified antenna of claim 12 wherein said holding means comprises:

an elongated boom having two symmetrical half sections, said boom being formed to follow said substantial parabolic orientation along its longitudinal axis, and means releasably connectable to said support for mounting to the inwardly directed ends of said boom half sections, said boom half sections being capable of pivoting in said mounting means from an outward position wherein said boom half sections form said substantial parabolic orientation to an inward collapsed position.

15. An improved modified parabolic antenna for receiving incoming signals, said antenna having low wind load characteristics and being mounted to a support, said antenna having means for sensing reflected signals in its focal area, said improved antenna comprising:

a boom having two symmetrical ends, said boom being formed to follow a substantially parabolic curve along its longitudinal axis, means for mounting said boom to said support, a first series of spaced reflector elements mounted on one of said symmetrical ends, each of the reflectors in said first series being mounted to said boom wherein the ends of each element in said first series extend outwardly from said longitudinal axis of said boom, a second series of spaced reflector elements mounted on the remaining symmetrical end of said boom, each of the reflectors in said second series being mounted to said boom wherein the ends of said second series extend outwardly from said longitudinal axis of said boom, and all of said reflector elements in said first and second series being identical in shape and being formed to follow a substantially parabolic curve, said first and second series of reflector elements being capable of reflecting said incoming signals into said sensing means.

16. The modified parabolic antenna of claim 15 wherein all of said reflector elements are mounted in perpendicular relationship to said boom.

17. The modified parabolic antenna of claim 15 wherein the spacings between the reflector elements in said first and second series are equal in a plane perpendicular to the incoming signals.

18. The modified parabolic antenna of claim 15 wherein said mounting means is capable of mounting said boom to said support in a vertical or in a horizontal orientation.

19. The modified parabolic antenna of claim 15 wherein the length of said boom is greater than the length of each of said reflector elements in said first and second series.

20. The modified parabolic antenna of claim 15 having at least five reflector elements each in said first and second series.

21. An improved modified parabolic antenna for receiving incoming signals, said antenna having low wind load characteristics and being mounted to a support, said antenna having means for sensing reflected signals in its focal area, said antenna comprising:

an elongated boom having two symmetrical ends, said boom being formed to follow a substantially parabolic curve along its longitudinal axis, means for mounting said boom to said support, a first series of spaced elongated reflector elements mounted on one of said symmetrical ends, each of the reflectors in said first series being mounted to said boom wherein the ends of each element in said first series extend outwardly from said longitudinal axis of said boom, a second series of spaced elongated reflector elements mounted on the remaining symmetrical end of said boom, each of the reflectors in said second series being mounted to said boom wherein the ends of each element in said second series extend outwardly from said longitudinal axis of said boom, and all of said reflector elements in said first and second series being identical in shape, being formed to follow a substantially parabolic curve, and being mounted in perpendicular relationship to said boom, the length of said boom being greater than the length of each of said reflector elements in said first and second series.

22. An improved parabolic antenna for receiving incoming signals, said antenna having low wind load characteristics and being mounted to a support, said antenna having means for sensing reflected signals in its focal area, said improved antenna comprising:

an elongated boom having two symmetrical ends, said boom being formed to follow a substantially parabolic curve along its elongated axis, means for mounting said boom to said support, a first series of thin elongated reflector elements mounted on one of said symmetrical ends, the center area of each of the reflectors in said first series being mounted to said boom wherein the ends of each element in said first series extend outwardly from and normal to said elongated axis of said boom, said reflector elements in said first series being spaced apart from each other.

a second series of thin elongated reflector elements mounted on the remaining symmetrical end of said boom, each of the reflectors in said second series being mounted to said boom wherein the ends of each element in said second series extend outwardly from and normal to said elongated axis of said boom, said reflector elements in said second series being spaced apart from each other, and all of said reflector elements in said first and second series being identical in shape and being formed to follow a substantially parabolic curve along an elongated axis, said reflector elongated axis being normal to said boom elongated axis, the length of said boom being greater than the length of each of said reflector elements in said first and second series so that said first and second reflector elements when mounted on said boom are substantially rectangular in configuration around the periphery of said antenna when viewed in a plane normal to the direction of said incoming signals.

23. The improved antenna of claim 22 wherein said shape of each of said first and second series of reflector elements is substantially rectangular in configuration.

24. An improved parabolic antenna for receiving incoming signals, said antenna having low wind load characteristics and being mounted to a support, said antenna having means for sensing reflected signals in its focal area, said improved antenna comprising:

an elongated boom being formed to follow a substantially parabolic curve along its elongated axis, means for mounting said boom to said support, a first series of thin elongated reflector elements mounted on one side of said boom, each of said elements in said first series being connected to said boom and normal to said elongated axis of said boom, said reflector elements in said first series being spaced apart from each other, a second series of thin elongated reflector elements mounted on the remaining side of said boom, each of the elements in said second series being connected to said boom normal to said elongated axis of said boom, said reflector elements in said second series being spaced apart from each other, and all of said reflector elements in said first and second series being identical in length and being formed to follow a substantially parabolic curve along an elongated axis, said reflector elongated axis being normal to said boom elongated axis, the length of said boom being greater than the length of each of said reflector elements in said first and second series so that said first and second reflector elements when mounted on said boom are substantially rectangular in configuration around the periphery of said antenna when viewed in a plane normal to the direction of said incoming signals.

* * * * *